4,363,605

United States Patent [19]

Mills

[11] 4,363,605
[45] Dec. 14, 1982

[54] APPARATUS FOR GENERATING AN ELECTRICAL SIGNAL WHICH IS PROPORTIONAL TO THE TENSION IN A BRIDLE

[76] Inventor: Manuel D. Mills, 2808 Delano, Midland, Tex. 79701

[21] Appl. No.: 203,529

[22] Filed: Nov. 3, 1980

[51] Int. Cl.[3] ..... F04B 49/06
[52] U.S. Cl. ..... 417/44; 73/151; 73/862.45
[58] Field of Search ..... 73/151, 862.45, 862.46, 73/862.47, 862.48; 417/44

[56] References Cited

U.S. PATENT DOCUMENTS

| | | | |
|---|---|---|---|
| 2,189,552 | 2/1940 | Raphael | 73/862.45 |
| 2,645,121 | 7/1953 | Scott | 73/862.48 X |
| 2,720,112 | 10/1955 | Coyne et al. | 73/862.47 |
| 3,023,615 | 3/1962 | Bennett | 73/862.47 |
| 4,043,191 | 8/1977 | Mills | 73/151 |
| 4,208,665 | 6/1980 | Mills | 73/151 X |

*Primary Examiner*—Jerry W. Myracle
*Attorney, Agent, or Firm*—Marcus L. Bates

[57] ABSTRACT

Apparatus for generating an electrical signal which is proportional to the tension in a bridle which supports a string of sucker rod associated with a pumpjack unit. The apparatus includes a main frame having a load cell mounted thereto, and opposed cable engaging arms, one of which extends from the load cell to a cable of the bridle. The two arms place the load cell in compression thereby generating an electrical signal in proportion to the magnitude of the force exerted to spring the spaced parallel cables apart from one another. The signal is utilized to obtain an indirect measurement which is proportional to the tension in the sucker rod. This signal can be combined with another signal related to the position of the walking beam of the pumpjack unit to thereby provide a dynamometer card. The signal is also used as a pump off control which discontinues current flow to the pumpjack motor when the signal assumes a predetermined electrical configuration.

8 Claims, 5 Drawing Figures

APPARATUS FOR GENERATING AN ELECTRICAL SIGNAL WHICH IS PROPORTIONAL TO THE TENSION IN A BRIDLE

BACKGROUND OF THE INVENTION

In my previous U.S. Pat. Nos. 3,851,995 and 4,208,665, there is disclosed apparatus for drawing a dynamometer card which is related to the pumping characteristics of a pumpjack unit. The apparatus includes means for measuring the tension in the sucker rod string by the provision of a spring loaded device which advantageously measures the force required to spring the bridle cables out of parallel relationship respective to one another.

It is known to utilize a load cell for weighing a mass. The modern load cell is usually a wheatstone bridge arranged in compact formed so that when the cell is placed in compression, a signal is generated proportional to the compressive force imposed upon the cell. The load cell is accurate, compact, relatively low in cost, and provides reliability.

The present invention discloses a load cell placed in compression by springing the bridle cables of a pumpjack unit towards one another so that the tension in the rod string can be indirectly measured in a fast and reliable manner.

SUMMARY OF THE INVENTION

Apparatus for indirectly measuring the tension in a member, such as a string of sucker rod, wherein the rod string is supportingly connected to a bridle, and wherein the bridle comprises two spaced load carrying cables. The apparatus of this invention includes a frame having a load cell mounted thereto which generates an electrical signal proportional to the compressive forces imposed thereon. The frame is connected to one of the bridle cables by an attachment arm which extends perpendicular to the cables. The load cell is connected to the other bridle cable by a second attachment arm arranged perpendicular to the other cable, so that the spaced cables are sprung laterally and placed under the load of the rod string, thereby placing the load cell in compression.

The first and second attachment arms terminate in attachment means by which they are removably affixed to the cables of the bridle. Means are provided by which the length of the attachment arms can be adjusted, thereby placing the load cell under a compressive load which varies with the tension in the member connected to the bridle.

The signal from the load cell is used to observe the load characteristics of the member which is connected to the bridle, and in particular the maximum and minimum tension within the member. When the bridle is connected to the walking beam of a pumpjack and to a polish rod, the signal from the load cell is used as a pump-off control.

In another form of the invention, the signal from the load cell is combined with a signal which is proportional to the position of the polish rod to provide a dynamometer card.

Accordingly, a primary object of the present invention is the provision of a means for measuring the tension in a string of sucker rod connected to a pumpjack.

Another object of the invention is to provide a signal by measuring the force required to continually bias two bridle cables in a perpendicular direction respective to one another.

A further object of this invention is to provide a pump-off control which is actuated by a signal related to the tension in a rod string.

A still further object of this invention is to provide a signal by measuring the varying tension force to which the bridle of a pumpjack unit is subjected, and combining the signal with a second signal related to the position of the rod string to thereby provide a dynamometer card.

Another and still further object of this invention is the provision of a means for measuring the dynamic tension in a bridle which supports a reciprocating string of sucker rod.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
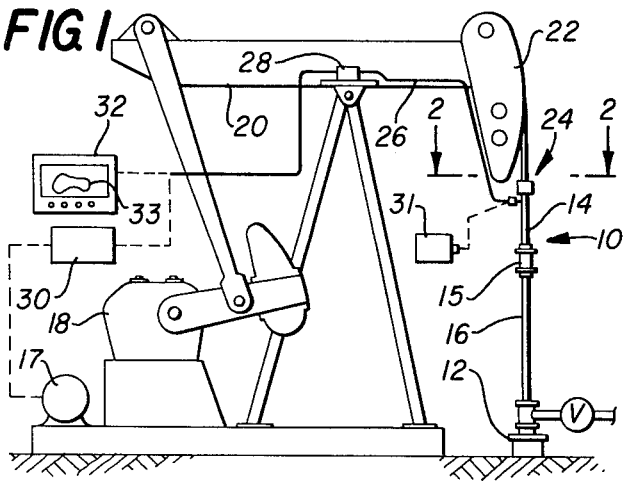
FIG. 1 is a part schematical, part diagrammatical, side elevational view of a pumpjack unit having apparatus made in accordance with the present invention associated therewith.

In FIG. 1, there is disclosed a pumpjack unit 10 located in operative relationship respective to a wellhead 12. A bridle 14, comprised of spaced apart parallel cables, is connected at 15 for supporting a polished rod 16 which reciprocates a string of sucker rods connected to the bottom end thereof (not shown).

An electric motor 17 drives a gear box 18 which in turn rocks a walking beam 20. The walking beam includes the illustrated horsehead 22 at one end thereof to which the bridle is attached and vertically moved in a reciprocatory manner by the oscillating horsehead, in the usual manner.

Apparatus 24, made in accordance with this invention, measures the tension in a member 16. The apparatus is connected to the bridle as will be more fully discussed later on. Electrical conductors 26 connect the apparatus 24 with a position transducer 28. A pump-off control apparatus 30 is connected to the signal generating apparatus 24 and to the electric motor 17 so that the motor is de-energized when the apparatus 24 senses a pump-off condition.

Numeral 31 indicates a portable unit for measuring the signal generated by the apparatus 24. Numeral 32 indicates a remotely located apparatus for integrating and plotting the two signals received from apparatus 24 and 28, so as to provide a dynamometer card or curve 33.

Figure 2:
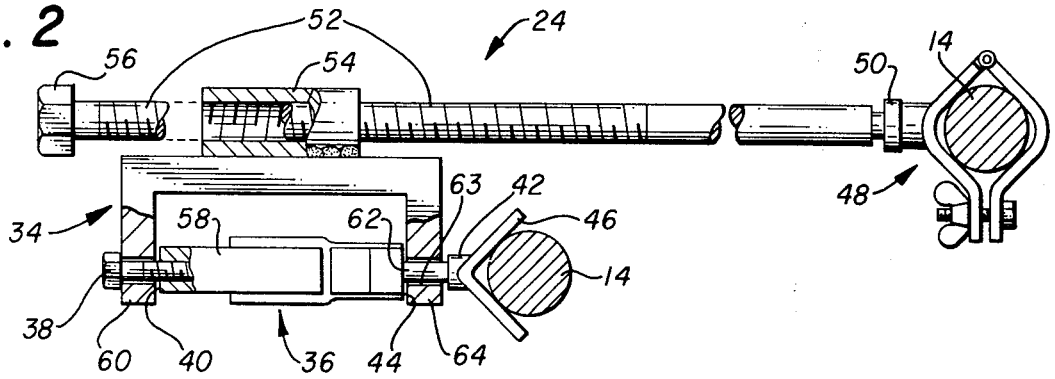
FIG. 2 is an enlarged, part cross-sectional view taken along line 2—2 of FIG. 1, with some parts being broken away therefrom and other parts being shown in cross-section.
Figure 3:
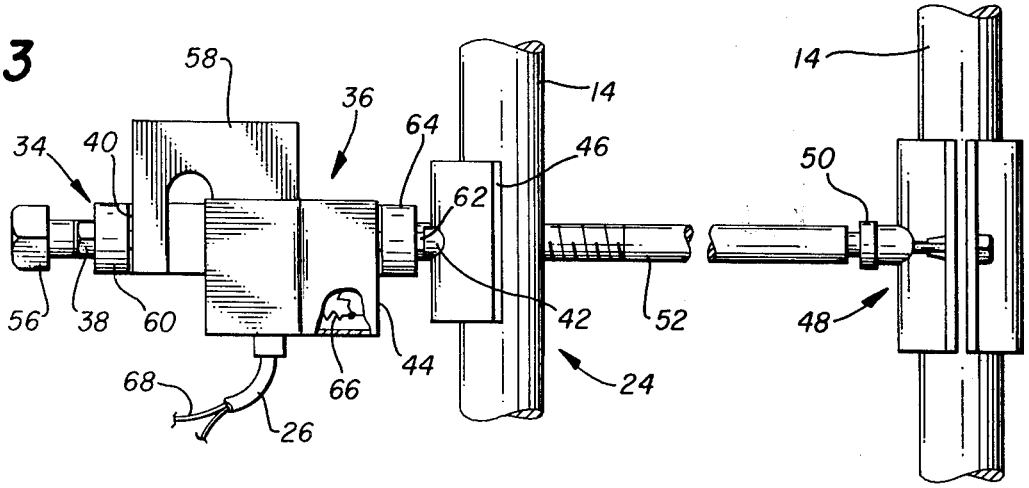
FIG. 3 is a side elevational view of part of the apparatus disclosed in FIG. 2.

As seen in FIGS. 2 and 3, the apparatus 24 includes a frame 34, which preferably is of a U-shaped configuration, and includes a load cell 36 mounted thereon. Fastener 38 connects the base 40 of the load cell to the main frame in such a manner that the load cell can pivot about the fastener respective to the frame. Force actuator 42 is connected to a shaft 62 and provides an attachment arm for a cable. The arm extends forwardly of face 44. Cable engaging means 46 is connected to the force actuator and to one of the bridle cables 14. The other bridle cable is engaged by the other cable engaging means 48, which preferably is in the form of a hinged clamp.

Clamp means 48 is connected by means of a swivel 50 to the other attachment arm, which preferably is in the form of a threaded connector 52. The connector threadedly engages an internally threaded boss 54. The boss is fixed to the frame. A hex-head 56 enables the effective length of the arm 52 to be adjusted respective to the arm 62.

The load cell is rigidly affixed to a load transfer frame 58 which forms the before mentioned face 40 for engagement with leg 60 of main frame 34. The other leg 64 of the main frame reciprocatingly receives the before mentioned arm 62 in a slidable manner within the illustrated bore 63.

The load cell includes circuitry 66, usually in the form of a wheatstone bridge, having electrical conductors 68 connected thereto for sending the generated signal to circuitry 30, 31, and 32.

Figure 4:
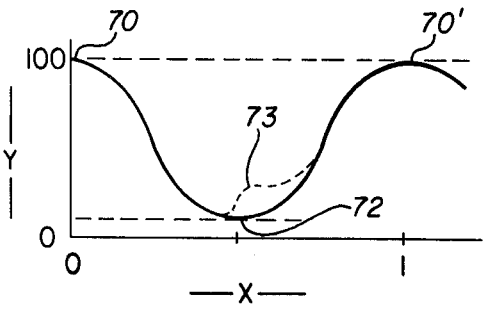
FIG. 4 is a plot showing the tension in a sucker rod during one cycle of operation of the pumpjack unit seen in FIG. 1; and, FIG. 5 is a diagrammatical representation of another form of the apparatus disclosed in FIG. 2.

As seen in FIG. 4, the tension Y within a sucker rod string changes in one cycle X of operation. The curve has a maximum tension peak 70, 70' on the upstroke and a minimum tension 72 on the downstroke. The electrical signal generated by the load cell is proportional to the load represented by the illustrated tension curves 70, 70'. When fluid pounding occurs in a wellbore, that is, when the well has "pumped off", the curve assumes a different pattern seen at 73 as compared to the configuration of the normal operation curve 70, 70' of FIG. 4. Advantage is taken of this signal variation to provide for shut-down of the pumpjack motor.

Figure 5:
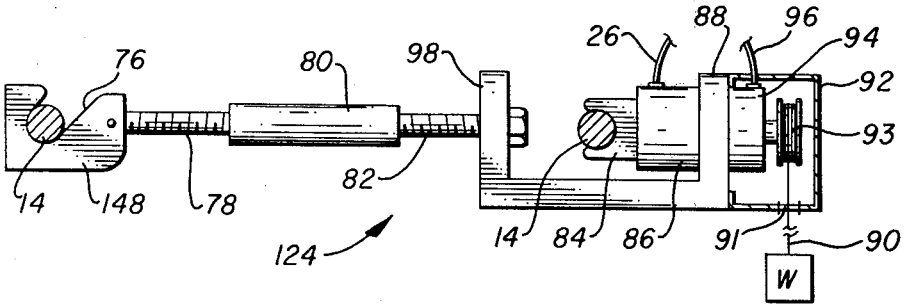

In FIG. 5, there is disclosed an alternant embodiment of the apparatus seen in FIGS. 2 and 3. As seen in FIG. 5, the cable engaging means 148 has a cable receiving slot 76 formed therewithin for receiving a bridle cable 14 therewithin. A threaded arm 78 is threadedly received within a turnbuckle 80, while a threaded arm 82, having an opposite pitch thread thereon, is threadedly received within the other end of the turnbuckle so that the effective length of the arm can be adjusted. A U-shaped cable engaging member 84 bears against the load cell 86 with force which is proportional to the lateral force exerted by the bridle cables 14. Electrical conductors 26 conduct the electrical signal from the load cell to either of apparatus 30, 31, and 32 of FIG. 1.

A flexible line 90 received through aperture 91 of housing 92 is connected to the illustrated weight and roved about pulley 93. The weight is placed on the ground. Pulley 93 is geared to a rheostat 94. Conductors 96 are connected from the resistance element of the rheostat to the recorder apparatus 32 of FIG. 1. Apparatus 94 eliminates the necessity for the position indicator 28 of FIG. 1. Frame 98 is connected to the near end of the threaded arm 82.

In operation, the pumpjack motor 17 is de-energized to bring the oscillating horsehead to a stop. The apparatus of the present invention is placed between the bridle, and the attachment means 46, 48 extended into contact with the bridle cables. Adjustment screw 52 is then engaged at 56 with a suitable wrench and the cables are forced to move slightly toward one another until the tension reading meter at 31 assumes an appropriate value. The pumpjack motor 16 is energized and the peak and minimum rod tension 70, 72 monitored at 31 or 32.

As the sucker rod string reciprocates the downhole pump, the tension in the bridle cables changes, thereby forcing the arm 62 against the load cell with a varying force as exemplified by the curve in FIG. 4. By moving a recorder pin scribe, such as seen at 32, along one axis in proportion to the up and down stroke, and concurrently moving the pin scribe along the Y axis in accordance with the signal generated by the load cell, a dynamometer card as seen at 33 is scribed. The dynamometer card is useful in analyzing the pumping characteristics of the well.

Should the production pump "pump off", fluid pounding will occur, causing the curve of FIG. 4 to assume the dot-dash configuration illustrated by numeral 73. This change in normal pumping signal characteristic is utilized at 30 to de-energize motor 17 so that the well is "shut-in" for a predetermined length of time depending upon the history of the well. It is considered within the comprehension of those skilled in the art of electrical circuitry to provide suitable circuitry for distinguishing between the curve 72 and 73 so as to control the operation of motor 17 as noted above.

The combined signals from the apparatus 24 and 28 can also be remotely relayed to either an oscilligraph or a chart drawing apparatus 32 so that the well can be continuously monitored from a central control area.

I claim:

1. In a pump jack unit having a motor controlled by a switch means, said pump jack unit includes a bridle which has two spaced load carrying bridle cables, the improvement comprising:

an apparatus for generating an electrical signal which is proportional to the tension in the bridle cable, said apparatus includes a main frame, a load cell which generates an electrical signal proportional to the load imposed thereon when the load cell is placed in compression, means by which said load cell is supported by said frame;

means including a first attachment arm extending perpendicular to one bridle cable by which said frame is connected to said one bridle cable, means including a second attachment arm by which the other bridle cable is attached to the load cell to cause the load cell to be placed in compression when the bridle cables are placed in tension;

means for adjusting the effective distance between the outer ends of said first and second attachment arms so as to bias the bridle cables within a plane which is perpendicular to the bridle cables;

and further including a circuit means for controlling the switch means to the motor of the pumpjack unit; said circuit means is responsive to said signal for actuating said switch means when said signal is of a predetermined configuration, so that said circuit means can be used to de-energize the motor of a pumpjack unit whenever a pump-off condition is encountered.

2. The apparatus of claim 1, and further including a transducer for generating a signal related to the vertical position of the bridle cables, and a recorder means for plotting the load cell signal versus the transducer signal to thereby plot a curve in the form of a dynamometer card.

3. The apparatus of claim 1, wherein said frame is in the form of a U having spaced legs bridged together at one end, said load cell is affixed to one leg, the bridge of the frame threadedly receives an elongated threaded member, clamp means at one end of the threaded member, said attachment arm which is affixed to the load cell and places the load cell in compression when the bridle cables are urged apart.

4. The apparatus of claim 1, and further including a transducer for generating a signal related to the vertical position of the bridle, and a recorder means for plotting the load cell signal versus the transducer signal to thereby plot a curve in the form of a dynamometer card;

said frame is in the form of a U having spaced legs bridged together at one end, said load cell is affixed to one leg, the bridge of the frame threadedly receives an elongated threaded member, clamp means at one end of the threaded member, and said second attachment arm is a cable engaging means affixed to the load cell and placing the load cell in compression when the bridle cables are urged apart.

5. In a pump jack unit having a bridle which reciprocates a rod string, a motor for said pump jack unit, circuit means including a switch means for controlling the flow of current to the motor of the pump jack unit; the combination with said pump jack unit of an apparatus for generating an electrical signal which is proportional to the tension in the bridle which supports the string of sucker rods;

said apparatus comprising a frame, cable engaging means connecting said frame to one cable of the bridle; a load cell, means mounting said load cell to said frame; another cable engaging means connected between said load cell and another cable of the bridle such that the load cell is placed in compression when the rod string is placed in tension;

and, means by which said cable engaging means can be moved respective to one another to thereby resistingly move the bridle cables laterally respective to one another while increasing the compression placed on the load cell;

means responsive to said signal for actuating said switch means when said signal is of a predetermined configuration, so that said circuit means can be used to de-energize the motor of a pump jack unit whenever a pump-off condition is encountered.

6. The combination of claim 5, and further including a transducer for generating a signal related to the vertical position of the bridle, and a recorder means for plotting the load cell signal versus the transducer signal to thereby plot a curve in the form of a dynamometer card.

7. The combination of claim 5, wherein said frame is in the form of a U having spaced legs bridged together at one end, said load cell is affixed to one leg, one of said cable engaging means includes an elongated threaded member which threadedly engages the bridge of the frame; clamp means at one end of the threaded member, and cable engaging means affixed to the load cell in such a manner that the load cell is placed in compression when the bridle cables are urged out of parallel relationship respective to one another.

8. The combination of claim 5, and further including a transducer for generating a signal related to the vertical position of the bridle, and a recorder means for plotting the load cell signal versus the transducer signal to thereby plot a curve in the form of a dynamometer card;

wherein said frame is in the form of a U having spaced legs bridged together at one end, said load cell is affixed to one leg, the bridge of the frame threadedly receives an elongated threaded member, clamp means at one end of the threaded member, and cable engaging means affixed to the load cell and placing the load cell in compression when the bridle cables are urged out of parallel relationship.

* * * * *